US007409742B2

(12) United States Patent
Song et al.

(10) Patent No.: US 7,409,742 B2
(45) Date of Patent: Aug. 12, 2008

(54) SUCTION NOZZLE FOR A VACUUM CLEANER

(75) Inventors: Hwa-gyu Song, Gwangju (KR); Hyun-ju Lee, Gwangju (KR); Dong-houn Yang, Gwangju (KR); Jae-sun You, Gwangju (KR); Jung-hyeon Kim, Yongin-si (KR); Jun-young Lee, Yongin-si (KR)

(73) Assignee: Samsung Gwangju Electronics, Co., Ltd., Gwangju (KR)

( * ) Notice: Subject to any disclaimer, the term of this patent is extended or adjusted under 35 U.S.C. 154(b) by 0 days.

(21) Appl. No.: 11/436,535

(22) Filed: May 19, 2006

(65) Prior Publication Data

US 2007/0089263 A1 Apr. 26, 2007

(30) Foreign Application Priority Data

Oct. 21, 2005 (KR) ..... 10-2005-0099904

(51) Int. Cl.
*A47L 5/00* (2006.01)

(52) U.S. Cl. ..... 15/326; 15/419; 15/420

(58) Field of Classification Search ..... None
See application file for complete search history.

(56) References Cited

U.S. PATENT DOCUMENTS

| | | | | |
|---|---|---|---|---|
| 2006/0000053 | A1* | 1/2006 | Lim et al. | 15/415.1 |
| 2006/0000054 | A1* | 1/2006 | Lim et al. | 15/415.1 |
| 2006/0021188 | A1* | 2/2006 | Lee | 15/419 |

FOREIGN PATENT DOCUMENTS

| | | |
|---|---|---|
| GB | 1423555 | 2/1976 |
| JP | 01-223918 | 9/1989 |
| JP | 09-028834 | 2/1997 |
| JP | 09-028835 | 2/1997 |
| JP | 11-128128 | 5/1999 |
| JP | 2002-165733 | 6/2002 |

OTHER PUBLICATIONS

Australian Patent Office, Office Action issued Apr. 27, 2007 with respect to Australian Patent Application No. 2006202369 filed on Jun. 1, 2006.

* cited by examiner

*Primary Examiner*—David A Redding
(74) *Attorney, Agent, or Firm*—Blank Rome LLP

(57) ABSTRACT

A suction nozzle of a vacuum cleaner includes jet units for jetting air into positions where air streams collide with each other as air is drawn into a suction port of the nozzle from both side portions thereof, so as to prevent substantially the collision of air streams.

13 Claims, 5 Drawing Sheets

SUCTION NOZZLE FOR A VACUUM CLEANER

CROSS-REFERENCE TO RELATED APPLICATIONS

This application claims benefit under 35 U.S.C. § 119 (a) of Korean Patent Application No. 2005-99904 filed on Oct. 21, 2005, the entire contents of which is incorporated herein by reference.

FIELD OF THE INVENTION

The present invention relates to a vacuum cleaner. More particularly, the present invention relates to a suction nozzle of a vacuum cleaner for drawing in contaminants into a vacuum cleaner body from a cleaning surface.

BACKGROUND OF THE INVENTION

Generally, a vacuum cleaner draws in contaminants from a cleaning surface using a suction force of a vacuum source in a cleaner body and collects the drawn-in contaminants in the body. The vacuum cleaner includes the cleaner body, a suction nozzle facing the cleaning surface to draw in contaminants, and an extension pipe and a flexible hose to guide the contaminants drawn in via the suction nozzle into the cleaner body.

The suction nozzle includes, substantially at a central portion thereof, a suction port that receives a suction force to draw in contaminants. Accordingly, the suction force is strong at the central portion having the suction port whereas the suction force is weaker further from the central portion. Accordingly, the central portion which has the suction port can easily draw in contaminants so as to increase cleaning efficiency; however, side portions remote from the central portion have a decreased cleaning efficiency.

To solve that problem, a guide passage formed at the side portions of the suction port is often used to transmit the suction force through the suction port to the side portions of the suction port. Air drawn in via the side portions of the guide passage is collected all at once, thereby increasing flow speed. Because of turbulence caused by air streams colliding against each other, undesirable noise is generated.

JP Publication H1-1223918 discloses a suction nozzle having a protruding piece substantially at a center of one side of the suction port that serves as a partition. The protruding piece can prevent air streams drawn in via the suction port from directly colliding with each other and generating, thereby reducing noise resulting from the turbulence. Although air stream drawn in from the side portions along the guide passage do not directly collide with each other by the protruding piece; the air still makes noise when colliding with each side surface of the protruding piece.

Additionally, because the suction force exerts on both side portions of the suction port based on the protruding piece, alien materials, such as hairs, are held by a lower end of the protruding piece, thereby decreasing the suction force.

SUMMARY OF THE INVENTION

The present invention has been conceived to solve the above-mentioned problems occurring in the prior art, and an aspect of the present invention is to provide a suction nozzle for a vacuum cleaner that can reduce a noise generated at a suction port of a suction nozzle.

Another aspect of the present invention is to provide a suction nozzle for a vacuum cleaner that can prevent alien materials, such as dust or hair, from remaining on a suction port of a suction nozzle.

In order to achieve the above aspects, there is provided a suction nozzle of a vacuum cleaner including jet units to jet air onto positions, where air streams collide with each other as air is drawn into a suction port from both side portions thereof, so as to substantially prevent a collision of the air streams.

The jet units may guide air from one side of the suction nozzle onto a sidewall of the suction port. The jet units may include an inlet penetrating the suction nozzle, a jet opening formed at a sidewall of the suction port of the suction nozzle, and a connection path to connect the inlet with the jet opening in a fluid communication. The jet units may jet air perpendicularly to air drawn in from the both side portions of the suction nozzle. The jet units may jet air in an air curtain form.

The jet opening may have greater length than width. The jet opening may be any shape, such as substantially rectangular or an oval. The jet opening may be formed at a central portion of the sidewall of the suction port to prevent a collision of air streams drawn in from side portions to the suction port.

The connection path may be a flexible tube or a bellows tube to freely communicate the inlet with the jet opening according to set positions of the inlet and the jet opening. Both ends of the connection path may be detachably engaged with the inlet and the jet opening, respectively so as to be easily cleaned an inside of the connection path.

BRIEF DESCRIPTION OF THE DRAWINGS

The above and other aspects, features and advantages of the present invention will become more apparent and more readily appreciated from the following detailed description of the embodiment taken with reference to the accompanying drawings of which.

DETAILED DESCRIPTION OF THE EXEMPLARY EMBODIMENTS

Figure 1:
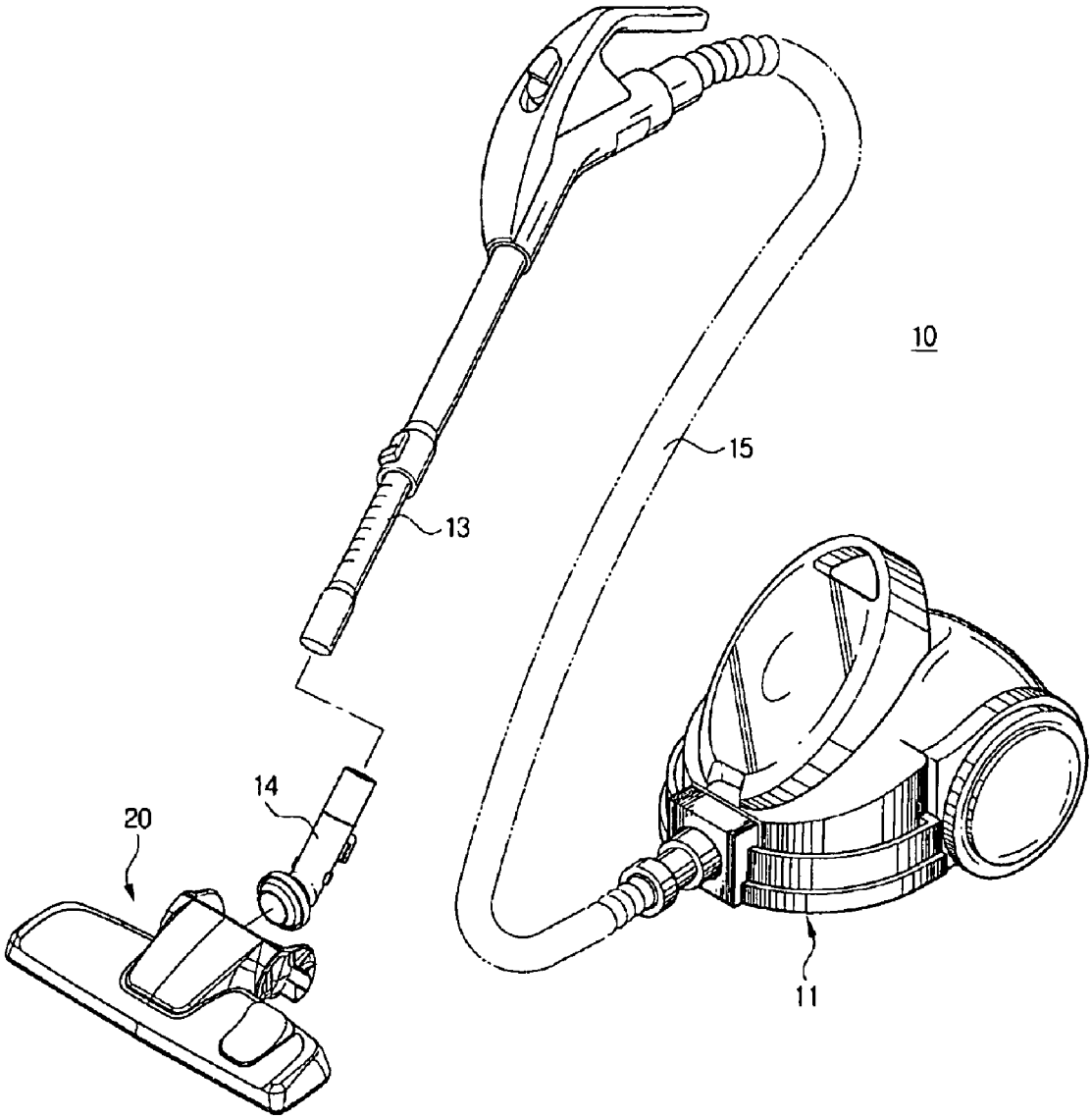
FIG. 1 is a perspective view of a vacuum cleaner employing a suction nozzle according to an embodiment of the present invention.

Exemplary embodiments of the present invention will be described in detail with reference to the annexed drawings. In the drawings, the same elements are denoted by the same reference numerals throughout the drawings. In the following description, detailed descriptions of known functions and configurations incorporated herein have been omitted for conciseness and clarity.

Referring to FIG. 1, a vacuum cleaner 10 employing a suction nozzle 20 according to an embodiment of the present invention includes a cleaner body 11 having therein a vacuum source (not shown), the suction nozzle 20 drawing in contaminant-laden air from a cleaning surface by a suction force generated from the vacuum source, and an extension pipe 13 connected to the suction nozzle 20 to guide the contaminated air drawn in via the suction nozzle 20 to the cleaner body 11. One end of the extension pipe 13 is connected to an extension pipe connector 14 rotatably engaged with the suction nozzle 20 and the other end thereof is connected to a flexible hose 15 engaged with the cleaner body 11.

Figure 2:
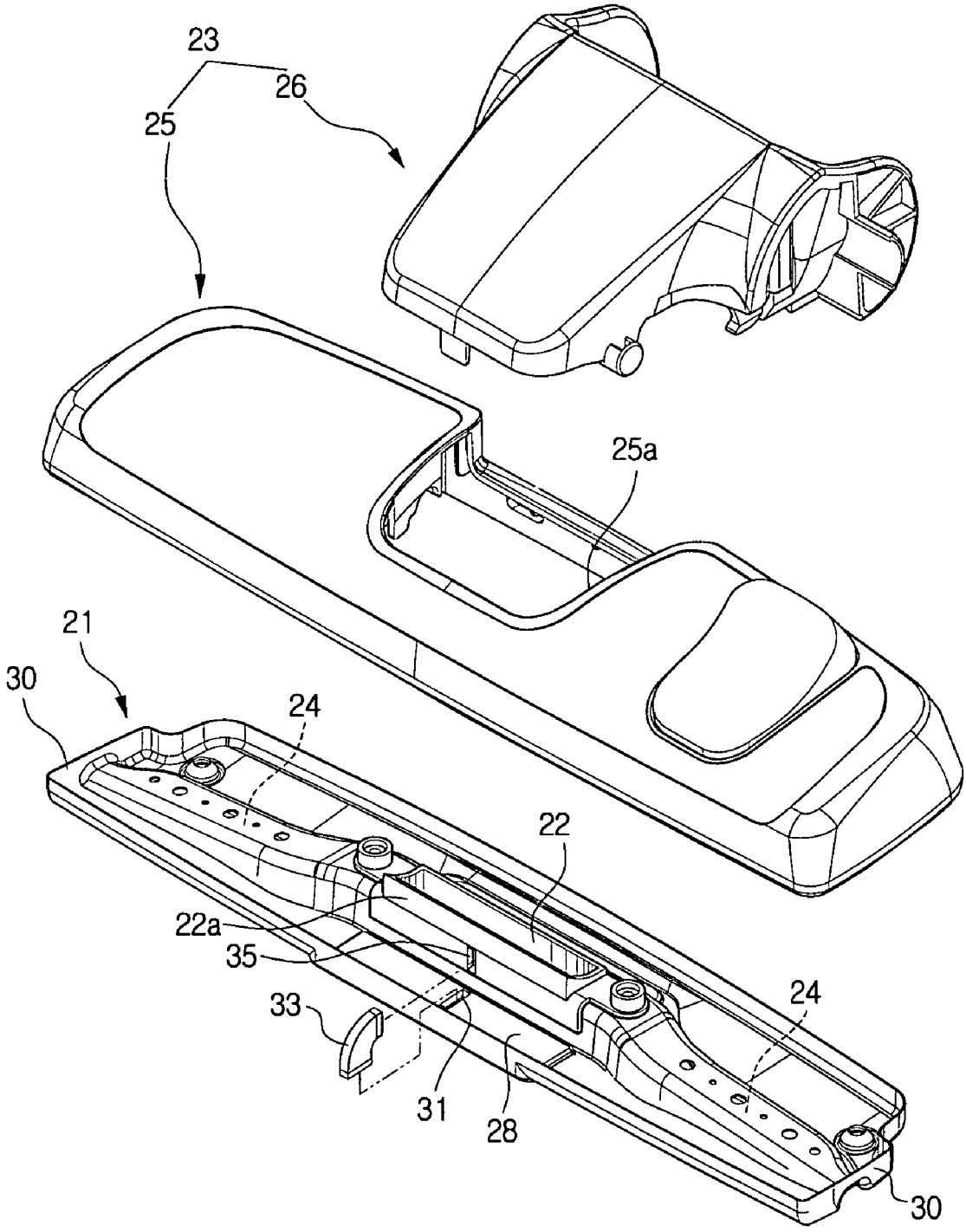
FIG. 2 is an exploded perspective view of the suction nozzle of the vacuum cleaner, illustrated in FIG. 1.
Figure 3:
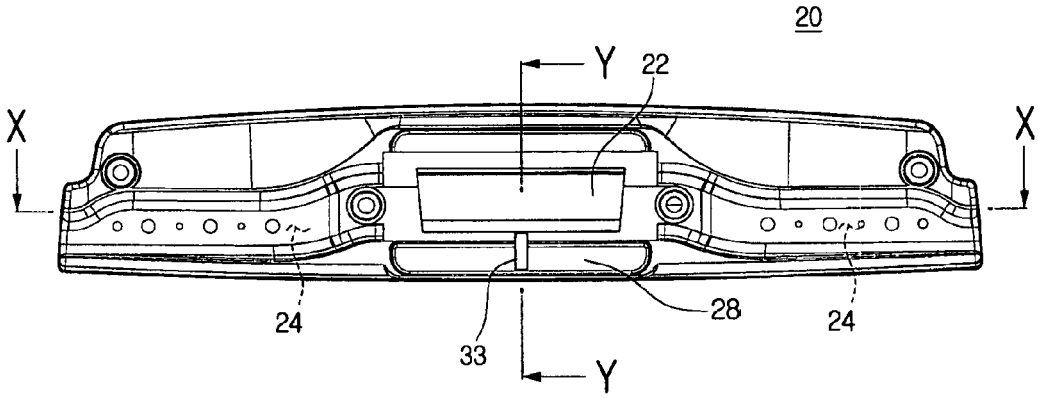
FIG. 3 is a plan view of a lower body of the suction nozzle illustrated in FIG. 2.

Referring to FIG. 2, the suction nozzle 20 comprises a lower body 21, an upper body 23 engaged with the lower body 21 and jet units 31, 33 and 35 jetting air to form a kind of blocking film so as to prevent a collision of air streams drawn in along a lower surface of the lower body 21 from the sides thereof.

The lower body 21 has at a central portion thereof a suction port 22 for drawing in contaminated air from the cleaning surface. The suction port 22 is configured as a substantial square with a predetermined height. The lower end of the suction port 22 is distanced at a predetermined distance from a bottom surface of the lower body 21.

Both side portions 30 of the suction port 22 have guide passages 24 that are symmetrically formed in a widthwise direction of the lower body 21 to be extended from the suction port 22 to opposite ends of the lower body 21. The guide passages 24 have a predetermined width in a backward and forward direction of the lower body 21 and a predetermined height from the bottom surface of the lower body 21. The guide passage 24 has a greater height closer to the suction port 22 from the opposite ends of the lower body 21. Accordingly, a suction force of a vacuum source (not shown) is transmitted through the suction port 22 to the guide passages 24 so that air at side portions 30 can be drawn in along the guide passages 24 as well as at the front portion of the suction port 22.

The upper body 23 comprises a passage cover 26 and an upper cover 25. Here, the upper body 23 may separately have the passage cover 26 and the upper cover 25 as shown; however, the passage cover 26 and the upper cover may be integrally formed.

The passage cover 26 is engaged with an upper portion of the lower body 21 having the suction port 22 to guide air drawn in via the suction port 22 to the extension pipe connector 14 (refer to FIG. 1). The passage cover 26 increases in height as closer to a rear portion thereof, i.e., the extension pipe connector 14. The passage cover 26 may be formed of a transparent material to observe the flowing of contaminants drawn in from the outside, and to check the status of the contaminants.

The upper cover 25 is engaged with an upper portion of the lower body 21 to hermetically seal the inside of the suction nozzle 20 from the outside. The upper cover 25 has a cut portion 25*a* that is cut to correspond to a shape of the passage cover 26. The passage cover 26 is exposed to the outside of the suction nozzle 20 through the cut portion 25*a*.

The jet units 31, 33 and 35 provide air jet passages that are connected from a leading end 28 of the lower body 21 to a front sidewall 22*a* of the suction port 22 in fluid communication, as shown in FIG. 2.

The jet units include an inlet 31 drawing in air from the leading end 28 of the lower body 21 by a suction source (not shown), a jet opening 35 penetrating the front sidewall 22*a* of the suction port 22, and a connection path 33 fluidly communicating the inlet 31 with the jet opening 35. In the present embodiment, the inlet 31 may be formed at the leading end 28 of the lower body 21; however the inlet 31 may be formed at any portion of the lower body 21 where air can be drawn in.

Figure 6:
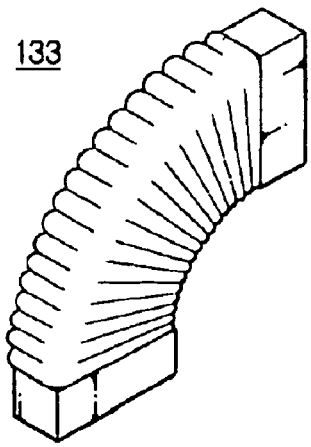
FIG. 6 is a perspective view of another example of a connection passage of the vacuum cleaner illustrated in FIG. 1.

The connection path 33 may be formed of a flexible tube with a predetermined length based on a position of the inlet 31. The connection path 33 is preferably flexible allowing connection of the inlet 31 with the jet opening 35 corresponding to the position of the inlet 31. Additionally, the connection path 33 may be formed as a tube of a bellows shape (refer to FIG. 6 showing an alternative connection path 133).

In the present embodiment, the position of the inlet 31 may be set closer to the jet opening 35 so that the connection path between the inlet 31 and the jet opening 35 is set to a short distance. The opposite ends of the connection path 33 may be detachably engaged with each of the inlet 31 and the jet opening 35 so that dust held in the connection path 33 can be easily removed. Here, the connection path 33 may be integrally formed with the lower body 21.

The jet opening 35 may be located at a central portion of the front sidewall 22*a* of the suction port 22 so as to draw in air that is substantially the same amount as from the side portions of the suction port 22 balancing the air drawn in via the suction port 22 along the guide passages 24.

Figure 5:
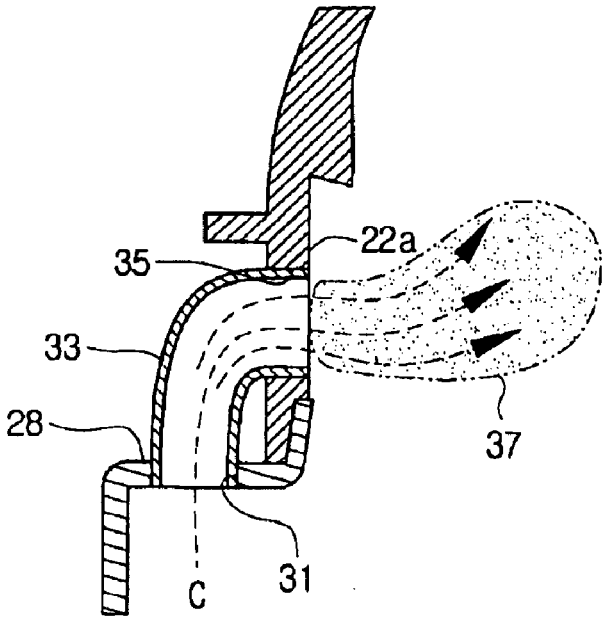
FIG. 5 is a cross-sectional view of a lower body of a suction nozzle taken on line Y-Y of FIG. 3.

In the present embodiment, the jet opening 35 may be formed at the front sidewall 22*a* of the suction port 22 as shown in FIG. 5. However, the jet opening 35 may be formed at a central portion of a rear sidewall of the suction port 22 in view of the position of the inlet 31 and the length of the connection path 33.

Figure 4:
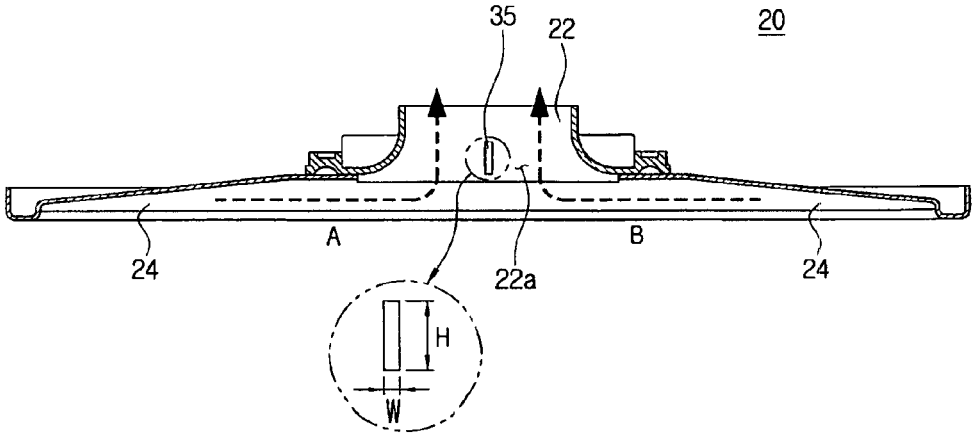
FIG. 4 is a cross-sectional view of a lower body of the suction nozzle taken on line X-X of FIG. 3.

The jet opening 35 may be a height H greater than a width W, as shown in FIG. 4, so that an air curtain 37 (FIG. 5) formed by jetted air can be configured as a partition with a thin width. The width W and the height H of the jet opening 35 may be set to prevent a collision of air streams and maximally maintain an amount of air drawn in along the guide passages 24. In the present embodiment, the jet opening 35 is substantially rectangular; however, the jet opening 35 may be formed in any shape, such as an oval.

The operation and effect of the suction nozzle 20 of the vacuum cleaner having the above structure according to an embodiment of the present invention will be explained.

Referring to FIG. 1, a suction force generated from the vacuum source (not shown) built in the cleaner body 11 is transmitted through the flexible hose 15, the extension pipe 13, and the extension connector 14 to the suction port 22 of the suction nozzle 20. Referring to FIG. 4, air is drawn in from the side portions 30 of the suction portion 22 along the guide passages 24 in arrows A and B directions by the suction force transmitted to the suction port 22. Air is drawn in via the suction port 22.

Simultaneously, as air is jetted into the suction port 22 through the jet opening 35, air drawn in via the inlet 31 is jetted through the connection path 33 via the jet opening 35, as shown in FIG. 5. Air drawn in and jetted along direction C forms the air curtain 37 having a predetermined width in a vertical direction corresponding to the shape of the jet opening 35. Forming the air curtain 37, air jetted through the jet opening 35 is continuously drawn in via the suction port 22 into the cleaner body 11.

The air curtain 37 is substantially perpendicular to the direction of air flow drawn in via the suction port 22 from the side portions 30 along the guide passages 24. Accordingly, air drawn in via the suction port 22 from the side portions 30 along the guide passages 24, is dispersed and raised by the air curtain 37 to flow out of the suction port 22. In other words, the air curtain 37 prevents a noise generated when different air streams are gathered at once toward the suction port 22 and collide with each other.

Further, in comparison with a conventional art that uses a solid protruding piece to block air, the suction nozzle according to an embodiment of the present invention uses the air curtain 37 based on an air stream with flowability to prevent the collision of air flowing in opposite directions. The air curtain may also serve as a buffer. Accordingly, the noise resulting from an increased flow speed and turbulence can be significantly decreased when air streams from both side portions collide with each other.

Figure 7:
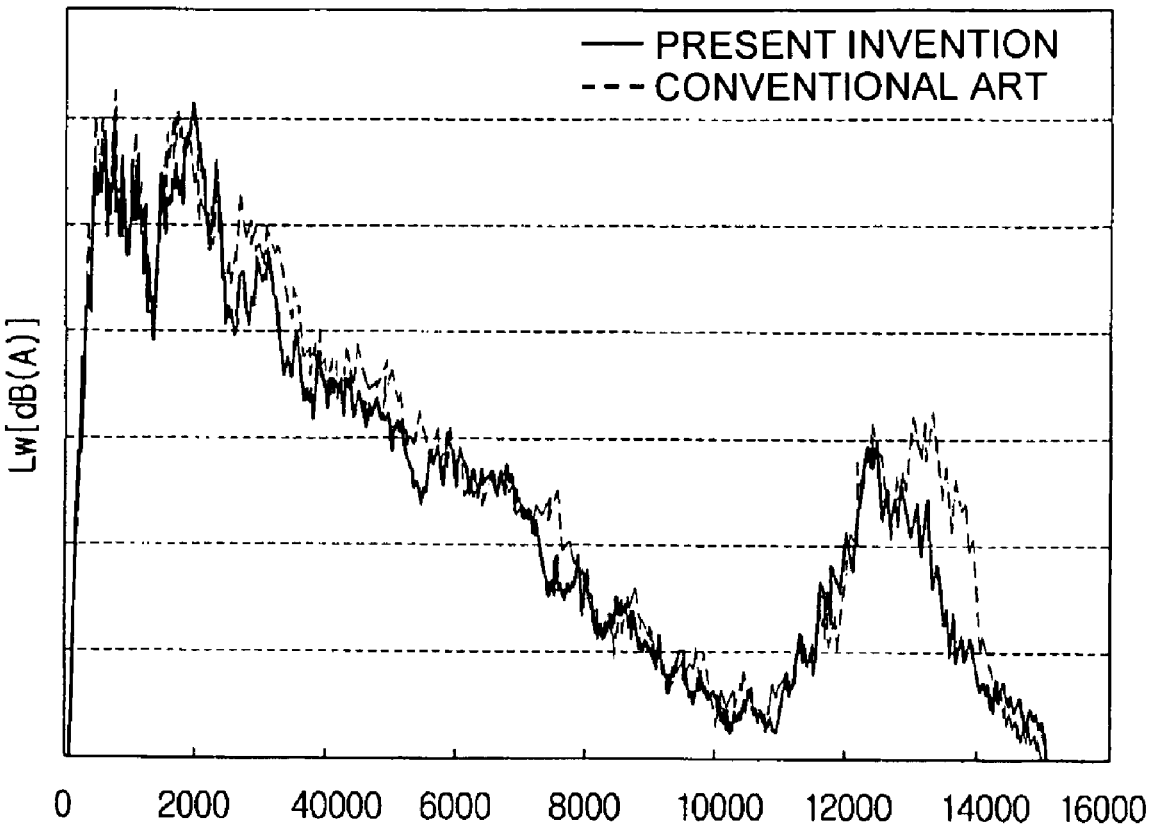
FIG. 7 is a graph comparing noises between when a suction nozzle according to an embodiment of the present invention is applied and when a conventional suction nozzle is applied.

FIG. 7 is a graph comparing noises between when the air curtain 37 according to an embodiment of the present invention is formed and when the air curtain 37 is not formed through repeated experiments. As shown, when the air curtain 37 is formed, the noise is reduced by appropriate 1.0 dB.

As air forming the air curtain 37 is drawn into the suction port 22 together with air flowing along the guide passages 24 from the both side portions, the suction force can is increased. Additionally, since air can be drawn in at three positions, i.e. both side portions and a front portion of the suction nozzle 20, the suction pressure is entirely reduced and operationability can be increased by appropriate 15%.

Conventionally, because the same suction forces exert on the both side portions of the suction port based on the protruding piece, alien materials, such as hairs, are held by a lower end of the protruding piece. However, the suction nozzle according to an embodiment of the present invention uses an air stream so as to prevent various alien materials from being held around the suction port 22, and to allow a smooth drawing in air.

Referring back to FIGS. 1 and 2, contaminated air passing through the suction port 22 is guided by the upper body 23 to flow out of the suction nozzle 20. Then, passing the extension pipe connector 14, the extension pipe 13 and the flexible hose 15, contaminated air flows into the cleaner body 11 so that the contaminants are collected and air removed from the contaminants is discharged to the outside of the cleaner body 11.

As described above, the suction nozzle 20 of the vacuum cleaner according to an embodiment of the present invention has the air curtain 37 at the suction port 22 so as to prevent turbulence and to reduce a noise resulting from the turbulence. Additionally, the vacuum cleaner prevents alien materials, such as hairs, from being held around the suction port. Therefore, air can be smoothly drawn in. Further, the number of air passages flowing into the suction nozzle 20 increases to reduce the suction pressure. Accordingly, the operationability of the suction nozzle can be increased.

Additional advantages, objects, and features of the embodiments of the invention will be set forth in part in the description which follows and in part will become apparent to those having ordinary skill in the art upon examination of the following, or may be learned from practice of the invention. The objects and advantages of the embodiments of the invention may be realized and attained as particularly pointed out in the appended claims.

What is claimed is:

1. A suction nozzle for a vacuum cleaner, comprising:

a suction port including at least one sidewall;

a plurality of guide passages extending from the suction port to opposite ends of the suction nozzle;

a plurality of jet units including, an inlet disposed in the suction nozzle, a jet opening formed at the at least one sidewall, and an enclosed connection path with an opening at a first end and an opening at a second end, the enclosed connection path connecting the inlet at the first end with the jet opening at the second end in fluid communication, wherein the plurality of jet units jet air into the suction port to form an air curtain that prevents collision of a plurality of air streams drawn into the suction port from the guide passages.

2. The suction nozzle according to claim 1, wherein the jet units guide air from one side of the suction nozzle through the at least one sidewall of the suction port.

3. The suction nozzle according to claim 1, wherein the jet units jet air perpendicularly to air drawn in from the both side portions of the suction port.

4. The suction nozzle according to claim 1, wherein the jet opening is formed at a central portion of the sidewall of the suction port.

5. The suction nozzle according to claim 1, wherein the jet opening is disposed at a lower portion of the suction nozzle.

6. The suction nozzle according to claim 1, wherein the jet opening is rectangular.

7. The suction nozzle according to claim 1, wherein the jet opening is oval.

8. The suction nozzle according to claim 1, wherein the connection path is a flexible tube.

9. The suction nozzle according to claim 1, wherein the connection path is a bellows tube.

10. The suction nozzle according to claim 1, wherein both ends of the connection path are detachably engaged with the inlet and the jet opening, respectively.

11. A suction nozzle for a vacuum cleaner, comprising:

a suction port including side portions, a front sidewall, and a rear sidewall; and a plurality of jet units, each of the plurality of jet units including, an inlet disposed in the suction nozzle, a jet opening formed at one of the front sidewall and the rear sidewall, the jet opening having a height and a width, the height being greater than the width, and a connection path connecting the inlet with the jet opening in fluid communication, the connection path being a flexible tube, wherein the plurality of jet units jet air into an air curtain thereby preventing collision of air streams drawn into the suction port from the side portions.

12. A suction nozzle for a vacuum cleaner, comprising:

a suction port including side portions, a front sidewall, and a rear sidewall; and a plurality of jet units, each of the plurality of jet units including, an inlet disposed in the suction nozzle, a jet opening formed at one of the front sidewall and the rear sidewall, the jet opening having a height and a width, the height being greater than the width, and a connection path connecting the inlet with the jet opening in fluid communication, the connection path being a bellows tube, wherein the plurality of jet units jet air into an air curtain thereby preventing collision of air streams drawn into the suction port from the side portions.

13. A suction nozzle for a vacuum cleaner, comprising:

a suction port including side portions, a front sidewall, and a rear sidewall; and a plurality of jet units, each of the plurality of jet units including, an inlet disposed in the suction nozzle, a jet opening formed at one of the front sidewall and the rear sidewall, the jet opening having a height and a width, the height being greater than the width, and a connection path connecting the inlet with the jet opening in fluid communication, both ends of the connection path being detachably engaged with the inlet and the jet opening, respectively, wherein the plurality of jet units jet air into an air curtain thereby preventing collision of air streams drawn into the suction port from the side portions.

* * * * *